United States Patent [19]

Franco

[11] 4,411,359

[45] Oct. 25, 1983

[54] FLUID POUCH WITH INTEGRAL STRAW

[75] Inventor: Gino Franco, Canoga Park, Calif.

[73] Assignee: Magna Technologies, Inc., Thousand Oaks, Calif.

[21] Appl. No.: 274,877

[22] Filed: Jun. 18, 1981

[51] Int. Cl.[3] ..... B65D 77/28

[52] U.S. Cl. ..... 206/217; 215/1 A; 229/7 S

[58] Field of Search ..... 220/90.2; 215/1 A; 229/7 S; 206/217; 239/33

[56] References Cited

U.S. PATENT DOCUMENTS

| | | | |
|---|---|---|---|
| 2,689,149 | 9/1954 | Saltzman | 215/1 A X |
| 2,992,118 | 7/1961 | Daline | 215/1 A X |
| 3,799,914 | 3/1974 | Schmit et al. | 215/1 A X |
| 4,078,692 | 3/1978 | Stein | 220/90.2 |
| 4,194,674 | 3/1980 | Pearson | 227/7 S |
| 4,228,913 | 10/1980 | Mack et al. | 220/90.2 |

*Primary Examiner*—William T. Dixson, Jr.
*Assistant Examiner*—Brenda J. Ehrhardt
*Attorney, Agent, or Firm*—Stanley W. Sokoloff

[57] ABSTRACT

A pharmaceutical pouch constructed of two sheets of laminated plastic sealed together about their perimeter. An integrally formed straw and mounting flange is provided on its interior. The straw is secured to the pouch by sealing the flange between the two laminated sheets. The flange retains the straw in alignment with an indicated openable portion of the pouch. The straw has an accordian-like flexible central portion, and is stored inside the pouch in the compressed position such that the straw will expand through the opening when the pouch is opened.

2 Claims, 3 Drawing Figures

FLUID POUCH WITH INTEGRAL STRAW

PRIOR ART STATEMENT

This prior art statement is filed in conformance with Rule 1.98. The most pertinent prior art references of which applicant is aware comprise the following patents, copies of which are enclosed:

U.S. Pat. No. 4,228,913 to Mack, Oct. 21, 1980

U.S. Pat. No. 4,078,692 to Stein, Mar. 14, 1978

U.S. Pat. No. 3,779,914 to Schmit et al., Mar. 26, 1974

Mack shows a tab top can having a self contained drinking straw. The straw includes a resilient bellows structure on its bottom which serves to bias the top end of the straw against the underside of the tab top. A straw guide secured on the interior of the can aligns the top end of the straw with the underside of the tab top. The bellows structure forces the top end of the straw through the drinking slot formed when the tab top is removed from the can.

Stein shows a container with integral straw wherein a plastic or other material straw is packaged within the container either when the container is manufactured or when the container is filled. A portion of the straw is removably secured interiorly of the container to the pull tab opener wherein the upper end of the straw is automatically pulled exteriorly of the container when the pull tab is removed to expose the container contents.

Schmit shows a standable flexible container adapted for storing fluids and having side walls formed of a thin, preferably heat sealable, flexible sheet material. The container bottom is constructed so that when the container is filled, the bottom opens to form a broad base for supporting the container of fluid in a standing upright position. An elongated dispensing member enclosed within the container extends between a lower fluid compartment and an upper, dispensing member storage compartment. The dispensing member has a folded, or foldable, top portion capable of being unfolded into a dispensing position, and a relatively straight bottom portion which extends into the lower compartment. The bottom portion of the dispensing member cooperates with the container side walls to form a fluid tight seal therewith and, in concert with a seal formed in the dispensing member, a hermetic seal is established which isolates stored fluid in the lower compartment.

SUMMARY OF THE INVENTION

A pharmaceutical pouch constructed of two sheets of laminated plasic sealed together about their perimeter. On the interior of the pouch is provided an integrally constructed straw and mounting flange which is secured to the pouch by sealing the flange between the two laminated sheets. The flange retains the straw in alignment with an indicated openable portion of the pouch. The straw has an accordian-like flexible central portion, and is stored inside the pouch in the compressed position such that the straw will expand through the opening when the pouch is opened.

DETAILED DESCRIPTION OF THE INVENTION

My invention is a pharmaceutical pouch having an integral straw inside the pouch such that when the pouch is opened, the straw will extend through the opening for use. The pouch is intended to hold fluids and similar substances for easy consumption such as by persons in hospitals or who are otherwise less suited to the use of more conventional drinking or dispensing containers.

The pouch would have instructions on its outside to direct a user to open a particular corner by peeling apart the two sheets of laminated plastic which form the pouch. When the opening reaches the necessary size the flexible accordian-like central section of the straw expands and causes the end of the straw to extend through the opening. The straw may then be grasped for further extension if needed and used to withdraw the contents of the pouch.

Such a pouch greatly reduces the chances of spillage of liquids which is especially desirable in hospitals and similar situations.

Figure 1:
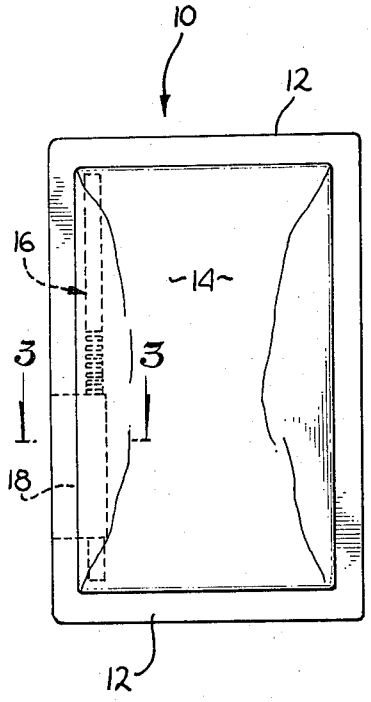
FIG. 1 shows the pouch in the closed position with the straw in phantom in the compressed position.

FIG. 1 shows a pouch 10 formed by heat sealing two sheets of laminated plastic around their perimeter so as to form a pouch perimeter 12 and thereby define a central volume 14. Within the central volume 14 there is provided an integrally formed straw 16 and mounting flange 18. As shown in FIG. 1 the straw 16 is in its compressed position. The details of construction of the pouch 10 are shown more clearly in FIG. 2.

The flange 18 secures the straw 16 in generally parallel alignment with one of the longer sides of the pouch 10. The straw 16 is provided with a generally central accordian like flexible area 22 and has a bottom end 20 and a top end 24. The pouch itself is correspondingly provided with bottom end 21 and a top end 25. It is formed by the heat sealing together of the perimeter of two sheets, sheet 26 and sheet 27 each of which may comprise a laminated sheet having laminations 28, 30 and 32. The specific nature of the material which is used to form the various laminations 28, 30 and 32 will of course depend upon the particular environment in which the pouch is intended to be used and on the particular type of fluid that is to be contained within the pouch. The flange 18 secures the straw within the pouch 10 such that the bottom end 20 of the straw is in closely spaced apart relationship with the bottom edge 15 of the central volume 14 of the pouch. As so restrained, fluid may freely be drawn into the bottom end 20 of the straw 16. This spaced apart relationship is insured by virtue of the placement of the flange 18 along one edge of the pouch 10. More specifically the distance from the top end 17 of the flange 18 to the bottom surface 15 of the interior volume 14 is selected to be greater than the distance between the top end 17 of flange 18 and the bottom end 20 of the straw 16. In addition the flange 18 aligns the straw 16 with the intended opening in the top of pouch 10. The opening is achieved by peeling apart the two laminated layers 26 and 27. As the laminated layers are peeled apart to form the opening in corner 34, the compressed condition of the flexible middle portion 22 causes the free end, that is the top end 24, of the straw to expand through the opening created in corner 34.

Figure 3:
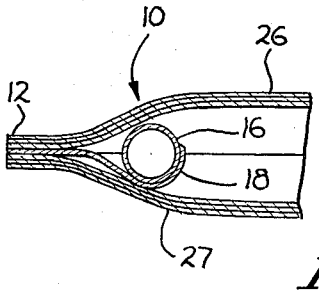
FIG. 3 is a section taken along the line 3—3 of FIG. 1.

The nature of flange 18 is more clearly indicated in FIG. 3. As there shown the straw 16 is integrally formed, such as by injection molding, with the flange 18. The flange 18 is placed between the two laminated layers 26 and 27 and secured therebetween just prior to the time that the perimeter of the two sheets 26 and 27 are sealed together, such as by heat sealing, to form the perimeter 12 of pouch 10.

It has been found that a particularly efficient method for forming the pharmaceutical pouch 10 is to begin by providing two long strips of laminate material off of roll stock. The width of each roll being chosen slightly greater than the length of the pouch 10. As the first sheet 27 comes off the roll, an electronic eye and control mechanism places an integral straw 16 and flange 18 on the sheet. The position of the flange 18 is critical. It must be placed such that the top end 24 of the straw 16 extends slightly onto that portion of the top of the first sheet 27 which will become heat sealed. Once the straw 16 and flange 18 are so positioned, heat is applied to the flange 18 and the first sheet 27 to tack the flange 18 into position. Next, hot air, i.e. about 130 degrees F. to 140 degrees F., is blown onto the straw 16. Because the straw 16 is made of polystyrene, the straw contracts longitudinally. When the straw has contracted about ¼ inch, its top end 24 no longer lies over that portion of the first sheet 27 which will be heat sealed. Now the second sheet 26 can be heat sealed to the first sheet 27 without heat sealing the top end 24 of the straw to either sheet. The two sheets are thus heat sealed on three sides, the top and two longer sides, and the bottom is left open. When the heat seal is completed the pouch is die stamped out of the two sheets along an edge lying within the sealed area of the three heat sealed edges. As the straw 16 cools it will expand until it contacts the top wall of the pouch interior volume 14 and will be unable to expand farther. The straw 16 will thus be held in slight compression ready to expand and extend outward when the pouch 10 is opened. The pouch, with three sides sealed, bottom left open and flange heat sealed between the two laminaged layers at one side, is conveyed to a filling station where it is filled through the open bottom and the bottom is heat sealed closed. The filled pouch is then ready for packing.

Figure 2:
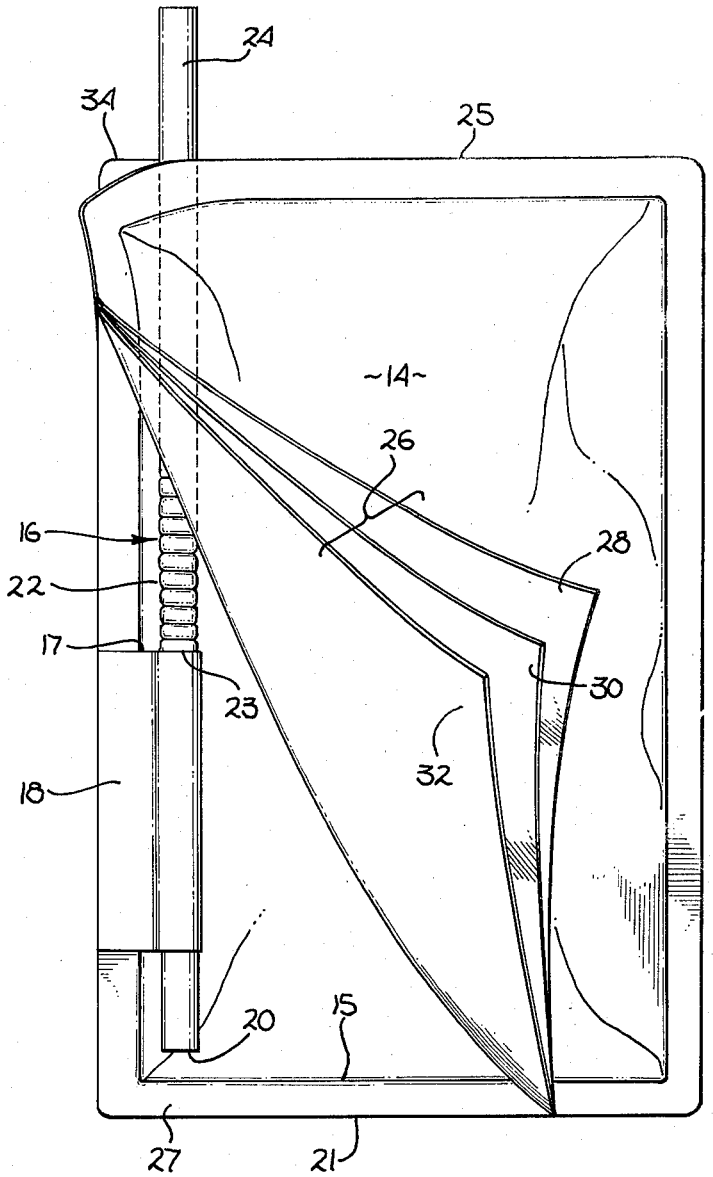
FIG. 2 shows the pouch opened at one corner with the top end of the straw extending therethrough.

While the invention has been described with particular reference to FIGS. 1 through 3 and has been described generally as a pouch constructed of laminated plastic for containing fluids, it should be understood that the description and figures are illustrative only and should not be taken in a limiting sense but rather merely in a descriptive sense. It is, of course, contemplated that many changes, additions and modifications to both structure and material as well as method could be made by one of ordinary skill in the art without departing from the spirit and scope of the present invention as set forth in the appended claims.

What is claimed is:

1. A pouch with an integral drinking straw comprising:

at least two sheets of laminated plastic sealed together along their perimeter;

an integrally formed unitary drinking straw and mounting flange, said mounting flange being secured along said sealed perimeter such that the drinking end of said straw that aligns with an intended opening in said pouch and such the fluid drawing end of said straw is maintained at least some distance away from the perimeter and walls of said pouch;

said unitary drinking straw having an integral longitudinally expandable and heat-contractable bellows section, said drinking straw being maintained within said pouch with said bellows section in compression;

whereby said drinking straw may be heat contracted into position during manufacture of said pouch and whereby said drinking straw will alignably expand toward and through said intended opening when said pouch is opened.

2. The pouch according to claim 1 wherein said flange is secured to said sealed perimeter by heat sealing of the two sheets of laminated plastic.

* * * * *